US006371341B1

(12) United States Patent
Clifton, Jr.

(10) Patent No.: US 6,371,341 B1
(45) Date of Patent: Apr. 16, 2002

(54) RELEASABLE BLOCK FOR ROTATING HOOD HOLSTER

(75) Inventor: Norman E. Clifton, Jr., Jax, FL (US)

(73) Assignee: Safariland Ltd., Inc., Ontario, CA (US)

( * ) Notice: Subject to any disclaimer, the term of this patent is extended or adjusted under 35 U.S.C. 154(b) by 0 days.

(21) Appl. No.: 09/562,085

(22) Filed: May 1, 2000

(51) Int. Cl.[7] ..... F41C 33/02
(52) U.S. Cl. ..... 224/243; 224/242; 224/911
(58) Field of Search ..... 224/192, 193, 224/235, 238, 242, 243, 911, 912, 246

(56) References Cited

U.S. PATENT DOCUMENTS 668,382 A * 2/1901 Martin
3,011,687 A * 12/1961 Boyt
3,688,953 A * 9/1972 Bianchi
4,325,505 A * 4/1982 Hillman ..... 224/911 X
5,501,381 A * 3/1996 Rogers et al. ..... 224/243

* cited by examiner

*Primary Examiner*—Gregory Vidovich
(74) *Attorney, Agent, or Firm*—Arthur G. Yeager

(57) ABSTRACT

A movable blocking member is pivotally mounted to the holster and movable between a first position where ratable motion of the hood is blocked and a second position where rotatable motion of the hood is allowed. The hood is rotated to allow a handgun to be removed from a holster. The hood must be depressed downwardly prior to rotation. In one aspect of the block the blocking member prevents rotation of the hood after downward motion of the strap. Alternate embodiments of the block provide a blocking member positionable to prevent the initial downward motion of the hood. Detents and detent recesses are provided to secure the blocking member in a desired position.

17 Claims, 5 Drawing Sheets

RELEASABLE BLOCK FOR ROTATING HOOD HOLSTER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to releasable blocking device to further enhance apparatus used to prevent the inadvertent withdrawal of a handgun from a holster and particularly to blocking devices for a rotating hood holster.

2. Related Art

Handgun holsters such as that disclosed in U.S. Pat. No. 5,501,381 employ a rotatable hood normally positioned in a manner to inhibit inadvertent withdrawal of the handgun. To further enhance. The effectiveness of such apparatus it is desired to provide a pivotal blocking device to make it more difficult for an assailant to grab and withdraw the handgun in a holster employing the device.

BRIEF SUMMARY OF THE INVENTION

In one aspect of the present invention there is provided a handgun holster comprising a quick release withdrawal restraint, an inner and outer sidewall joined together along lower front and back portions to define an inner cavity having an open top shaped to fit a handgun holstered therein, an elongated restraining strap having opposite ends and a medial portion bridging the sidewalls across the open top. There are means for pivotal attachment of the opposite ends of the strap to respective sidewalls to permit movement of the strap from a position across the open top to restrict handgun withdrawal to a position generally forwardly of the holster to permit handgun withdrawal. The means for pivotal attachment for preventing forward pivotal movement of the restraining strap until the strap is moved at the means for pivotal attachment in a downward direction. The detent means includes a fixed notch and a movable pawl adapted to engage the notch and to be disengaged from the notch when the strap is moved in the downward direction, the improvement comprising selectively operable blocking means attached to the holster movable between a first position to prevent forward pivotal movement of the strap after the strap has first been moved in the downward direction and a second position to allow forward pivotal movement of the strap after the strap has been moved in the downward direction.

The blocking means includes a blocking arm and means for pivotally mounting the blocking arm to the means for pivotal attachment, the blocking arm being selectively movable from a first position where the blocking arm is positioned closely adjacent the movable pawl to prevent forward pivotal movement of the movable pawl after the strap is moved in the predetermined direction by contact with the movable pawl and a second position where the blocking arm is spaced away from the movable pawl to allow forward pivotal movement of the movable pawl after the strap is moved in the predetermined location. The blocking means also includes second detent means releasably engaged between the means pivotal attachment and the blocking arm for securing the blocking in the first position. The second detent means includes a detent boss formed on the blocking arm and a detent recess formed in the means for pivotal attachment, the detent boss positioned in the detent recess when the blocking arm is in the first position.

In other aspects of the present invention, there is provided in a handgun holster including a quick release withdrawal restraint, an inner and outer sidewall joined together along lower front and back portions to define an inner cavity having an open top shaped to fit a handgun holstered therein, an elongated restraining strap having opposite ends and a medial portion bridging the sidewalls across the open top, means for pivotal attachment of the opposite ends of the strap to respective sidewalls to permit movement of the strap from a position across the open top to restrict handgun withdrawal to a position generally forwardly of the holster to permit handgun withdrawal, the means for pivotal attachment including a detent means releasably engaged with the means for pivotal attachment for preventing forward pivotal movement of the restraining strap until the strap is moved at the means for pivotal attachment in a downward direction, selectively operable blocking means attached to a holster movable between a first portion to prevent forward pivotal movement of the strap after the strap has been moved in the downward direction and a second position to allow forward pivotal movement of the strap after the strap has been moved in the downward direction. The blocking means includes a blocking arm and means for pivotally mounting the blocking arm to the means for pivotally mounting the blocking arm to the means for pivotal attachment, the blocking arm being selectively movable from a first position where the blocking arm is positioned closely adjacent the movable pawl to prevent forward pivotal movement of the movable pawl after the strap is moved in the downward direction by contact with the movable pawl and a second position where the blocking arm is spaced away from the movable pawl to allow forward pivotal movement of the movable pawl after the strap is moved in the downward direction. The blocking means includes detent means releasably engaged between the means for pivotal attachment and the blocking arm for securing the blocking arm in the first position. The detent means includes a detent boss formed on the blocking arm and a detent recess formed in the means for pivotal attachment, the detent boss positioned in the detent recess when the blocking arm is in the first position.

Further aspects of the present invention include a handgun holster comprising a quick release withdrawal restraint, an inner and outer sidewall joined together along lower front and back portions to define an inner cavity having an open top shaped to fit a handgun holstered therein, an elongated restraining strap having opposite ends and a medial portion bridging said sidewalls across the open top, means for pivotal attachment of the opposite ends of the strap to respective sidewalls to permit movement of the strap from a position across the open top to restrict handgun withdrawal to a position generally forwardly of the holster to permit handgun withdrawal, the means for pivotal attachment including a first detent means releasably engaged with the means for pivotal attachment for preventing forward pivotal movement of the restraining strap until the strap is moved at the means for pivotal attachment in a downward direction, wherein the first detent means includes a fixed notch and a movable pawl adapted to engage the notch and to be disengaged from the notch when the strap is moved in the downward direction. Also included is selectively operable blocking means attached to the holster and movable between a first position to prevent movement of the strap in the downward direction and a second position to allow movement of the strap in the downward direction. The blocking means includes a pawl and means for movably mounting the pawl to the means for pivotal attachment, the first position where the pawl is positioned closely adjacent the strap to contact the strap to prevent movement of the strap in the downward direction and the second position away from the strap to allow movement of the strap in the downward direction. The blocking means includes second detent means releasably engaged between the means for pivotal attachment and the pawl for securing the pawl in the first position. The second detent means includes at least one detent recess formed in the pawl and a detent boss formed in the means for pivotal attachment, the detent boss being positioned in the at least one detent recess when the pawl is in the first position. The blocking means includes second detent means releasably engaged between the means for pivotal attachment and the pawl for selectively securing the pawl in the first position and the second position. The second detent means includes a pair of spaced detent recesses formed in the pawl and a detent boss formed in the means for pivotal attachment, the detent boss being positioned in one recess when the pawl is in the first position and in another the recess when the pawl is in the second position. Additional aspects of the present invention include a handgun holster comprising a quick release withdrawal restraint, an inner and outer sidewall joined together along lower front and back portions to define an inner cavity having an open top shaped to fit a handgun holstered therein, an elongated restraining strap having opposite ends and a medial portion bridging the sidewalls across the open top, means for pivotal attachment of the opposite ends of the strap to the respective sidewalls to permit movement of the strap from a position across the open top to restrict handgun withdrawal to a position generally forwardly of the holster to permit handgun withdrawal, the means for pivotal attachment including a detent means releasably engaged with the means for pivotal attachment including a detent means releasably engaged with the means for pivotal attachment for preventing forward pivotal movement of the restraining strap until the strap is moved at the means for pivotal attachment in a downward direction. There is provided selectively operable blocking means for attachment to the holster including a pawl and means for movably mounting the pawl to the means for pivotal attachment, the pawl being selectively movable between a first position where the pawl is positioned closely adjacent the strap to contact the strap to prevent movement of the strap in the downward direction and a second position away from the strap to allow movement of the strap in the downward direction. The blocking means further includes detent means releasably engaged between the means for pivotal attachment and the pawl for selectively securing the pawl in the first position and the second position. The detent means includes a pair of spaced detent recesses formed in the means for pivotal attachment and a detent boss formed in the pawl, the detent boss being positioned in one recess when the pawl is in the first position and in another recess when the pawl is in the second position.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
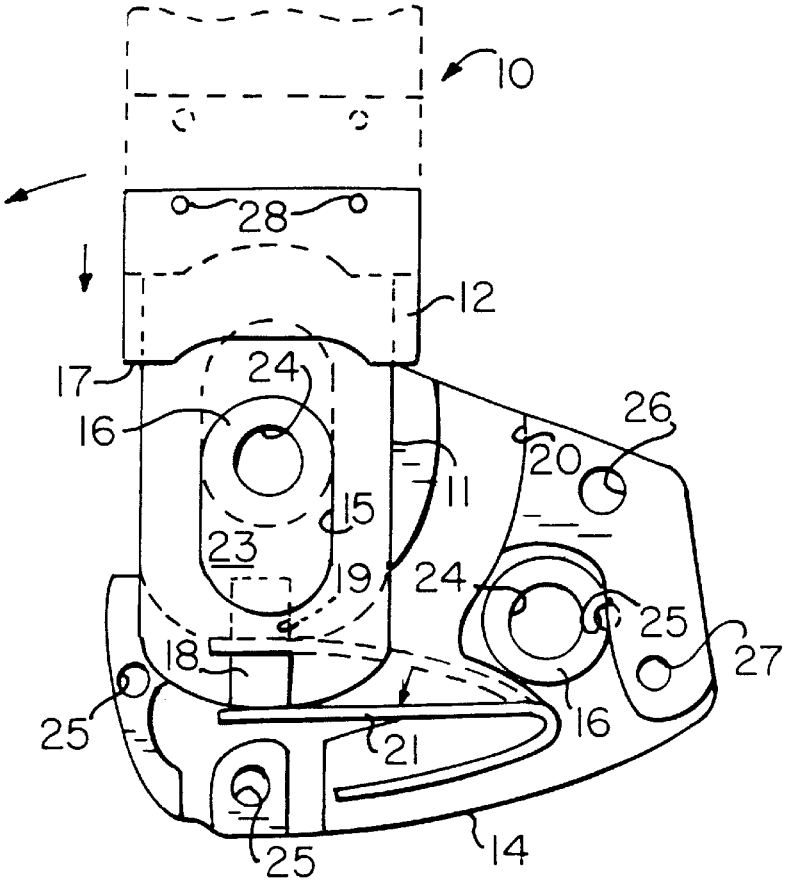
FIG. 1 is a pictorial view of a rotatable hood of a holster shown from the side closest to a wearer according to the present invention, the releasable blocking device not being shown for clarity.
Figure 2:
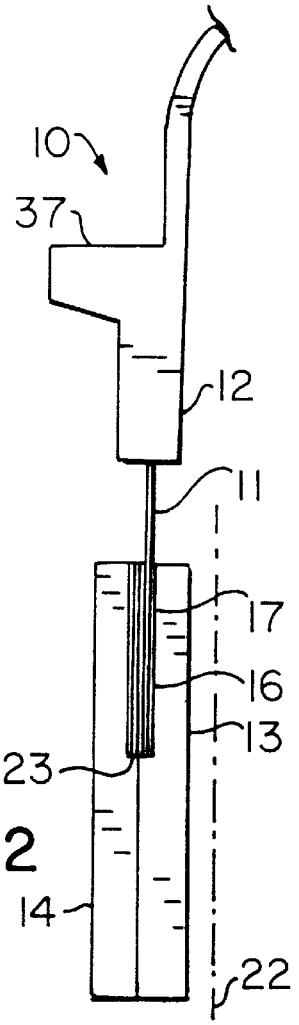
FIG. 2 is a side elevational view of the holster and hood of FIG. 1.

With reference now to the drawing, a detail of the rotating hood strap for a holster is shown at numeral 10 in FIGS. 1 and 2. The means for pivotal attachment of the strap 10 to the holster includes a thin metal extension leg 11 and a leg portion 12 that is part of the strap 10. The leg 11 is pivotally mounted within inside cover 13 (adjacent the holster) and outside cover 14 that are molded plastic parts. Two hollow cylindrical bosses 16 are formed of interiorly directed bosses molded as part of covers 13 and 14, which fit together. Screws and T-nuts are used to secure the covers together via holes 24 defined by the hollow bosses 16 and assembly holes 25.

Leg 11 has a centrally located slot 15 having a vertical lengthwise axis. Slot 15 encircles a boss 16. The lower end of leg 11 includes integral pawl 18 that extends outwardly to fit within a slot or notch 19 formed in the body of stationary metal plate 23. Plate 23 has a circular hole (not shown) through which passes one of the bosses 16.

Cam groove 20 is formed by the interior surfaces of covers 13 and 14 and provides a path for pivotal movement of pawl 18.

The means for pivotal attachment of the hood strap 10 and its operation is substantially identical to that illustrated in U.S. Pat. No. 5,501,381 and particularly to FIG. 8 therein. Some modifications have been made regarding the size and interior form of covers 13 and 14 that do not fundamentally change the operation of the device.

Holes 25 are used for assembly of the hood strap 10 by way of bolts or other means as may be desired in the circumstances. Hole or recess 26 is formed to carry a detent mounted pivotally on a rotatable arm at hole 27 as will be discussed hereinbelow. Posts 28 secure the upper portion of strap 10 to leg 12. Leaf spring 21 is mounted in a cavity formed in the interior surfaces of walls 13 and 14.

Downward movement (from broken line to solid line) of leg 11 against spring 21 provides for downward movement of pawl 18 out of slot 19. This allows for counterclockwise rotation of inside leg 12. Pawl 18 will ride in cam groove 20 during movement.

Figure 3:
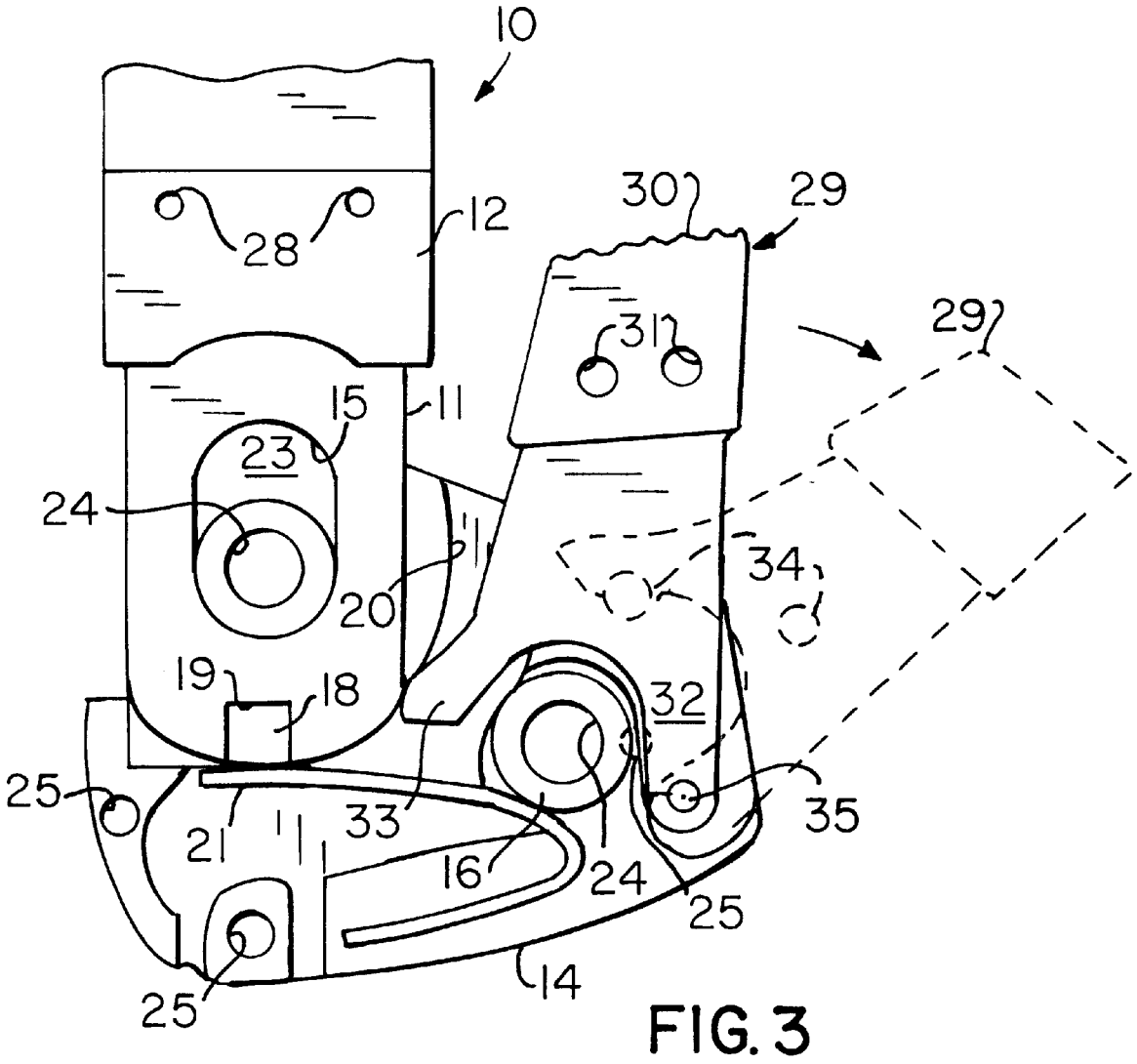
FIG. 3 is a pictorial view of the hood apparatus of FIG. 1 employing a releasable blocking device in accord with the present invention.

In FIG. 3, one embodiment of the releasable block apparatus 29 is illustrated. Serrated handle 30 is mounted via posts 31 to a body comprising a pivot arm 32 and a blocking arm 33 and is mounted to the pivot attachment means at pivot hole 27 by bolt 35. A detent boss 34 is mounted to fit into detent recess or hole 26 when block 29 is positioned as shown in solid line to block rotary movement of leg 11. Blocking arm 33 is mounted in the same plane as leg 11 in order to make contact with leg 11 when an attempt to rotate it is made and to thus prevent movement of the hood 10. Movement of apparatus 29 to the broken line position is accomplished by pushing on handle 30 in the direction of the arrow which will force detent 34 out of detent recess 26.

The detent boss 34 and the surface around detent recess 26 are smooth, hard, low friction surfaces that allow movement of blocker 29 with a minimum of effort but provide sufficient holding force to prevent accidental movement of the blocker 29. In addition, blocker 29 cannot be moved by an attempt to rotate hood 10 by force.

FIG. 2 illustrates a side view of the basic features of a rotating hood strap 10 with respect to a holster wall 22. Slot 17, formed by cutouts in walls 13 and 14, allows for rotating movement of leg 11 after it has been depressed as shown in FIG. 1. A similar slot exists in the apparatus of FIGS. 3 and 4.

FIGS. 4–8 illustrate another embodiment of a blocking member 36. Rotatable hood 10 is substantially the same as the hood strap 10 in FIGS. 1–3. Thumb ledge 37 is used to depress inside leg 12 downwardly to move pawl 18 on extension leg 11 out of notch 19 in stationary plate 23. As before, leg 11 is biased upwardly by spring 22. Hole 25 is used for assembly.

The releasable block apparatus 36 in this embodiment is designed to prevent downward movement of leg 11 unless the blocking device 36 has been rotated out of the way.

The block apparatus 36 consists of a movable engaging member 38 having a plastic body 39 with serrations 40 on top to allow for movement by a thumb of a user. The body 39 is formed to have a blocking boss or pawl 41 extending laterally from a travel limit ledge 42 as part of a forward arm portion 43. The rear arm portion is shown at 44.

The engaging member 38 is pivotally mounted to mounting bracket 46 by post 45 that fits into bracket hole 47. Bolts 53 fit into bolt holes 48 having countersunk lands 52 to movable hood 10 and therethrough to holster 22. Bracket 46 is designed to fit onto outside cover 14.

Figure 5:
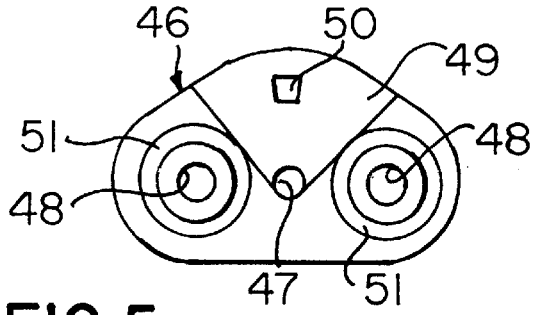
FIG. 5 is a plan view of the mounting bracket used in the device of FIG. 4.

The reverse of mounting bracket 46 is shown in FIG. 5 and includes a V-shaped channel 49 that has a laterally protruding detent boss 50 integral thereto. Upstanding lands 51 fit into countersunk grooves in inside cover 14 to provide a flush fit for the bracket 46.

Figure 6:
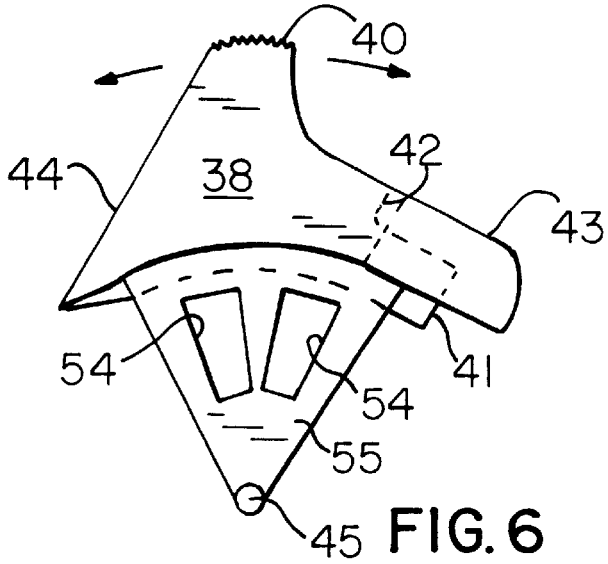
FIGS. 6–8 are three views of the movable engaging member employed in the device of FIG. 4.

The lower portion of engaging member 38 is shown in FIG. 6. Arm member portion 55 has two detent notches 54 formed therein for selective engagement with the detent boss 50 on the reverse of bracket 46 as shown in FIG. 5.

Figure 8:
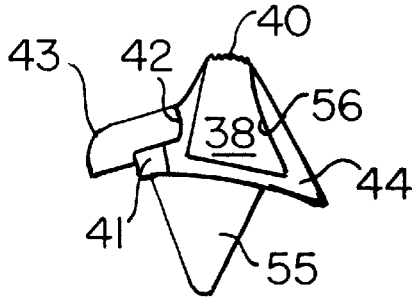

A reverse of the engaging member 38 is shown in FIG. 8. The member 38 is molded from a hard plastic and has an interior space 56 to reduce weight.

Figure 7:
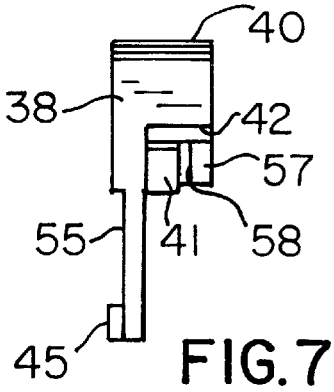

In FIG. 7 the forward portion of the member 38 is shown. Beneath ledge 42 is an extension of the body 39 to form a boss 57 that defines a vertical groove or slot 58 that is sized to carry an edge of extension leg 11 when the member 38 is in a blocking position as will be discussed hereinbelow.

With respect again to FIG. 4, the movement of the engaging member 38 forward as shown places blocking boss 41 below a lower edge 59 of inside leg 12 preventing downward movement thereof. The same motion places leg 11 edge into slot 58 and places travel limit ledge 42 against a lower portion of rearward edge 60 of leg 12. The combination of these actions prevents downward motion of legs 11 and 12 beyond clearances provided as manufacturing tolerances and accordingly, hood 10 cannot be rotated in a manner to allow removal of a handgun in holster 22 when engaging member 38 is positioned forwardly as shown. Rearward movement of engaging member 38 allows for downward movement of legs 11 and 12 and rotation of hood 10 because blocking boss 41 has been rotated out of the way. Detent boss 50 and the two detent notches 54 in arm member 55 provide for two positions of member 38.

Detent boss 50 and detent notches 54 are formed of a hard plastic with a smooth slick surface and rounded edges to allow movement but prevent movement of the engaging member 38 unless the user affirmatively operates the releasable block apparatus 36.

Figure 9:
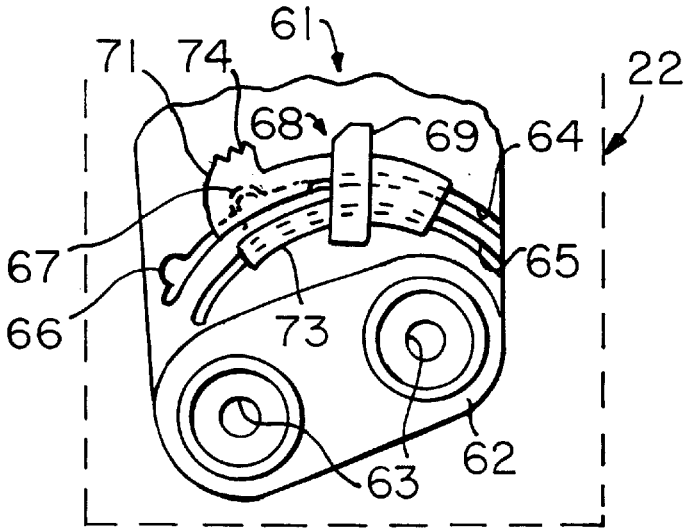
FIG. 9 is a side view of another releasable blocking device in accord with a third embodiment of the present invention.
Figure 10:
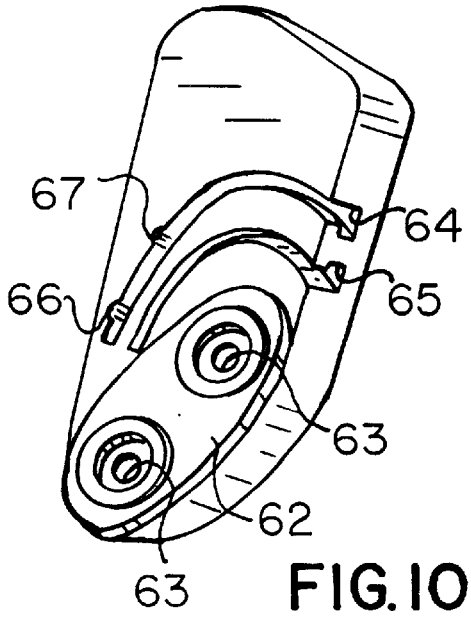
FIG. 10 is a perspective view of the blocking member of FIG. 9.
Figure 11:
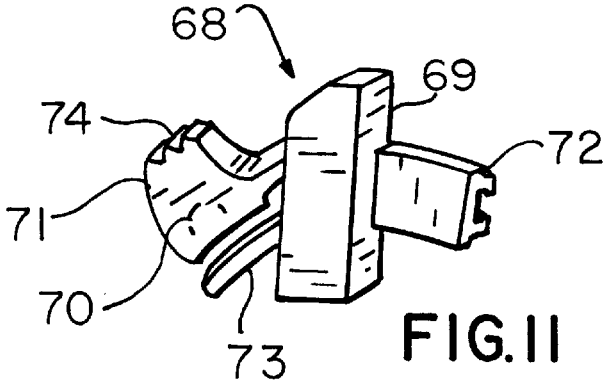
FIG. 11 is a perspective view of the mounting bracket of FIG. 9.

In FIGS. 9–11 another embodiment of a releasable blocking device according to the present invention is illustrated at numeral 61. Mounting bracket 62 has two holes 63 for mounting to the pivot attachment means and it to a holster 22 (shown only pictorially) in the same manner as the devices of FIGS. 1–8. Two tracks in the form of arcuate channels 64, 65 are formed within the bracket 62. The upper channel 64 has two notches 66 and 67 formed therein. A first rearward notch 66 is used to secure the engaging member 68 into an open position allowing for the rotation of strap hood 10.

Figure 4:
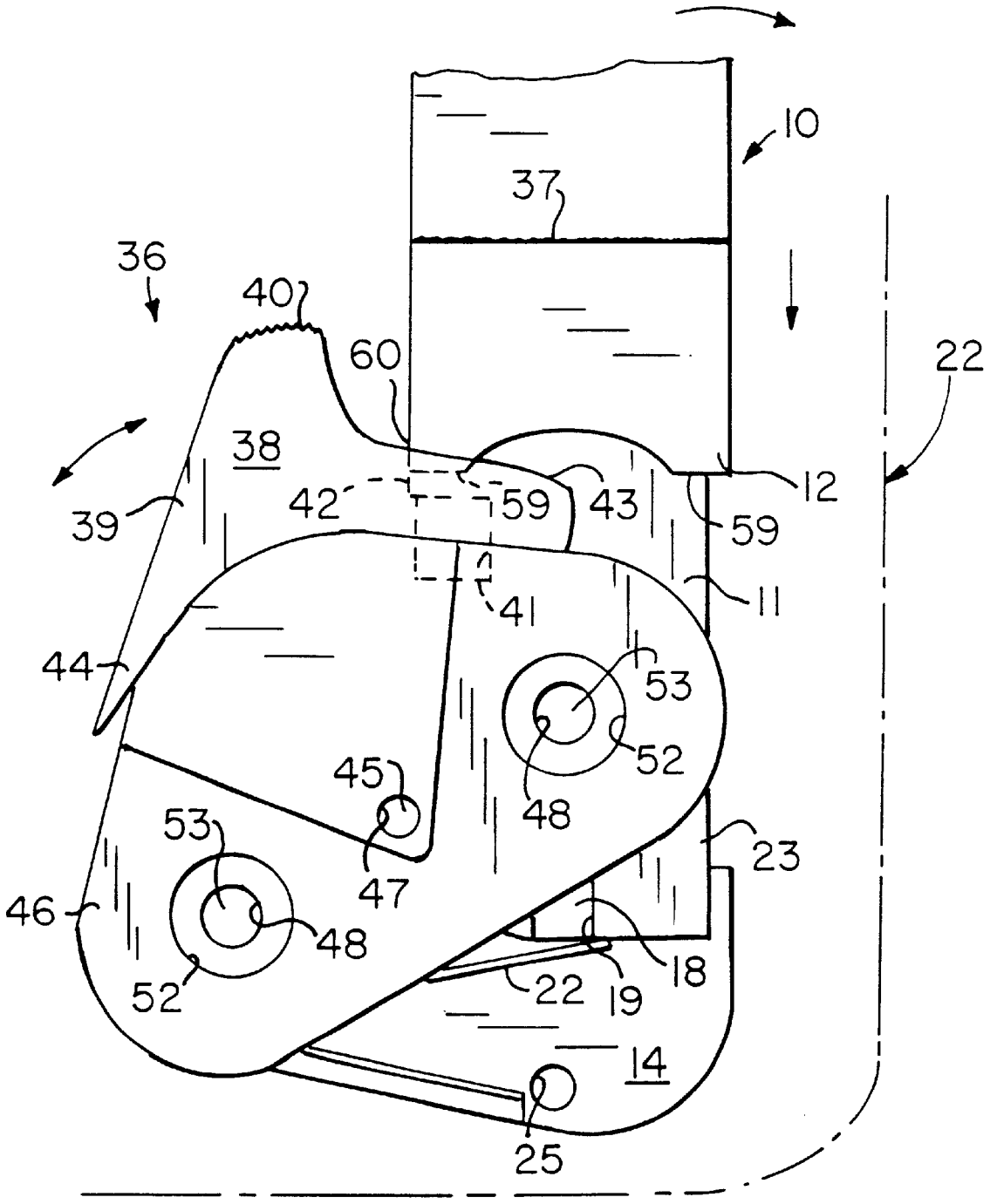
FIG. 4 is a diagrammatic view of another releasable blocking device in accord with a second embodiment of the present invention.

A second forward notch 67 is used to secure member 68 into a forward locked position to prevent downward movement of legs 11 and 12 in a manner similar to that shown in FIG. 4.

With respect to FIG. 11, the engaging member 68 includes a blocking post 69 for downward contact with a lower edge 59 of inside leg 12 to limit travel of leg 12 to prevent pawl 18 from being moved out of notch 19 when engaging member 68 is in the forward locked position. Spring lever 71 is biased upwardly to position laterally extending detent or boss 70 into either notch 66 or 67 as desired. Guide bracket 72 is fitted to slide inside channels 64 or 65.

Below spring lever 71 is a sliding guide member 73 that is an extension of engaging member 68 and rests inside lower channel 65. Downward pressure on spring lever 71, which preferably includes a serrated top portion 74, will cause downward movement of boss 70 out of the notch 66 or 67 that it was in so that engaging member 68 can be moved between a first open position and a second locked position as desired.

In each of the figures, the embodiment illustrated is designed to fit on and become part of the pivot attachment means used to attach the hood 10 to the holster 22.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A handgun holster comprising, an inner and outer sidewall joined together along lower front an back portions to define an inner cavity having an open top shaped to fit a handgun holstered therein, an elongated restraining strap having opposite ends and a medial portion bridging said sidewalls across said open top, means for pivotal attachment of said opposite ends of said strap to respective said sidewalls to permit movement of said strap from a position across said open top to restrict handgun withdrawal to a position generally forwardly of said holster to permit handgun withdrawal, said means for pivotal attachment including a detent means releasably engaged with said means for pivotal attachment for preventing forward pivotal movement of said restraining strap until said strap is moved at said means for pivotal attachment in a downward direction, wherein said detent means includes a fixed notch and a movable pawl adapted to engage said notch and to be disengaged from said notch when said strap is moved in said downward direction, the improvement comprising selectively operable blocking means attached to said holster cooperatively engaging said strap for preventing movement of said strap in a forward pivotal direction prior to disengaging of said blocking means from said strap.

2. The holster as defined in claim 1 wherein said blocking means includes a blocking arm and means for pivotally mounting said blocking arm to said means for pivotal attachment, said blocking arm being selectively movable from a first position where said blocking arm is positioned closely adjacent said movable pawl to prevent rearward pivotal movement of said movable pawl after said strap is moved in said downward direction by contact with said movable pawl and a second position where said blocking arm is spaced away from said movable pawl to allow rearward pivotal movement of said movable pawl after said strap is moved in said downward direction.

3. The holster as defined in claim 2 wherein said blocking means includes second detent means releasably engaged between said pivotal attachment means and said blocking arm for securing said blocking arm in said first position.

4. The holster as defined in claim 3 wherein said second detent means includes a detent boss formed on said blocking arm and a detent recess formed in said means for pivotal attachment, said detent boss positioned in said detent recess when said blocking arm is in said first position.

5. In a handgun holster including an inner and outer sidewall joined together along lower front and back portions to define an inner cavity having an open top shaped to fit a handgun holstered therein, an elongated restraining strap having opposite ends and a medial portion bridging said sidewalls across said open top, means for pivotal attachment of said opposite ends of said strap to respective said sidewalls to permit movement of said strap from a position across said open top to restrict handgun withdrawal to a position generally forwardly of said holster to permit handgun withdrawal, said means for pivotal attachment including a detent means releasably engaged with said means for pivotal attachment for preventing forward pivotal movement of said restraining strap until said strap is moved at said means for pivotal attachment in a downward direction, selectively operable blocking means attached to a holster cooperatively engaging said strap for preventing movement of said strap in a forward pivotal direction prior to disengaging of said blocking means from said strap.

6. The holster as defined in claim 5 wherein said blocking means including a blocking arm and means for pivotally mounting said blocking arm to said means for pivotal attachment, said blocking arm being selectively movable from a first position where said blocking arm is positioned closely adjacent said movable pawl to prevent rearward pivotal movement of said movable pawl after said strap is moved in said downward direction by contact with said movable pawl and a second position where said blocking arm is spaced away from said movable pawl to allow rearward pivotal movement of said movable pawl after said strap is moved in said downward direction.

7. The holster as defined in claim 6, said blocking means including detent means releasably engaged between said means for pivotal attachment and said blocking arm for securing said blocking arm in said first position.

8. The holster as defined in claim 7 wherein said detent means including a detent boss formed on said blocking arm and a detent recess formed in said means for pivotal attachment, said detent boss positioned in said detent recess when said blocking arm is in said first position.

9. A handgun holster comprising an inner and outer sidewall joined together along lower front and back portions to define an inner cavity having an open top shaped to fit a handgun holstered therein, an elongated restraining strap having opposite ends and a medial portion bridging said sidewalls across said open top, means for pivotal attachment of said opposite ends of said strap to respective said sidewalls to permit movement of said strap from a position across said open top to restrict handgun withdrawal to a position generally forwardly of said holster to permit handgun withdrawal, said means for pivotal attachment including a first detent means releasably engaged with said means for pivotal attachment for preventing forward pivotal movement of said restraining strap until said strap is moved at said means for pivotal attachment in a downward direction, wherein said first detent means includes a fixed notch and a movable pawl adapted to engage said notch and to be disengaged from said notch when said strap is moved in said downward direction, selectively operable blocking means attached to said holster and movable between a first position to prevent movement of said strap in said downward direction and a second position to allow movement of said strap in said downward direction.

10. The holster as defined in claim 9 wherein said blocking means includes another pawl and means for movably mounting said another pawl to said means for pivotal attachment, said another pawl being selectively movable between said first position where said another pawl is positioned closely adjacent said strap to contact said strap to prevent movement of said strap in said downward direction and said second position being away from said strap to allow movement of said strap in said downward direction.

11. The holster as defined in claim 10 wherein said blocking means includes detent means releasably engaged between said means for pivotal attachment and said another pawl for securing said another pawl in said first position.

12. The holster as defined in claim 11 wherein said detent means of said blocking means includes at least one detent recess formed in said pawl and a detent boss formed in said means for pivotal attachment, said detent boss being positioned in said at least one detent recess when said pawl is in said first position.

13. The holster as defined in claim 10 wherein said blocking means includes detent means releasably engaged between said means for pivotal attachment and said another pawl for selectively securing said another pawl in said first position and said second position.

14. The holster as defined in claim 13 wherein said detent means of said blocking means includes a pair of spaced detent recesses formed in said another pawl and a detent boss formed in said means for pivotal attachment, said detent boss being positioned in one said recess when said another pawl is in said first position and in another said recess when said another pawl is in said second position.

15. A handgun holster comprising an inner and outer sidewall joined together along lower front and back portions to define an inner cavity having an open top shaped to fit a handgun holstered therein, an elongated restraining strap having opposite ends and a medial portion bridging said sidewalls across said open top, means for pivotal attachment of said opposite ends of said strap to respective said sidewalls to permit movement of said strap from a position across said open top to restrict handgun withdrawal to a position generally forwardly of said holster to permit handgun withdrawal, said means for pivotal attachment including a detent means releasably engaged with said means for pivotal attachment for preventing forward pivotal movement of said restraining strap until said strap is moved at said means for pivotal attachment in a downward direction, selectively operable blocking means for attachment to said holster including a pawl and means for movably mounting said pawl to said means for pivotal attachment, said pawl being selectively movable between a first position where said pawl is positioned closely adjacent said strap to contact said strap to prevent movement of said strap in said downward direction and a second position away from said strap to allow movement of said strap in said downward direction.

16. The holster as defined in claim 15 wherein said blocking means further includes another detent means releasably engaged between said means for pivotal attachment and said pawl for selectively securing said pawl in said first position and said second position.

17. The holster as defined in claim 16 wherein said another detent means includes a pair of spaced detent recesses formed in said means for pivotal attachment and a detent boss formed in said pawl, said detent boss being positioned in one said recess when said pawl is in said first position and in another said recess when said pawl is in said second position.

* * * * *